US005536083A

United States Patent [19]

Brüstle et al.

[11] Patent Number: 5,536,083

[45] Date of Patent: Jul. 16, 1996

[54] PULL-OUT GUIDE ASSEMBLY FOR DRAWERS

[75] Inventors: Klaus Brüstle, Höchst; Helmut Hollenstein, Lustenau; Erich Röck, Höchst, all of Austria; Fredi Dubach, Adetswil, Switzerland

[73] Assignee: Julius Blum Gesellschaft m.b.H., Höchst, Austria

[21] Appl. No.: 418,779

[22] Filed: Apr. 7, 1995

Related U.S. Application Data

[63] Continuation-in-part of Ser. No. 203,375, Mar. 1, 1994, abandoned.

[30] Foreign Application Priority Data

Mar. 4, 1993 [AT] Austria ..... 412/93
Jan. 17, 1994 [AT] Austria ..... 71/94

[51] Int. Cl.[6] ..... A47B 88/06; A47B 88/00

[52] U.S. Cl. ..... 312/334.6; 312/334.8; 312/334.12

[58] Field of Search ..... 312/334.6, 334.7–334.14, 312/334.37, 334.39, 334.41, 334.16–334.21; 384/19, 58

[56] References Cited

U.S. PATENT DOCUMENTS

| | | | |
|---|---|---|---|
| 2,099,148 | 11/1937 | Tobey | 312/334.39 X |
| 2,747,943 | 5/1956 | Metcalf . | |
| 3,477,770 | 11/1969 | Neimi . | |
| 3,574,437 | 4/1971 | Stein et al. | 312/334.19 |
| 3,929,387 | 12/1975 | Grass | 384/19 |
| 4,176,890 | 12/1979 | Gorton | 312/343 |
| 4,436,357 | 3/1984 | Röck et al. | 312/334.12 |
| 4,595,247 | 6/1986 | Zank | 312/334.19 |
| 4,601,522 | 7/1986 | Röck | 312/334.21 X |
| 4,752,143 | 6/1988 | Lautenschläger, Jr. | 312/334.39 X |
| 5,344,227 | 9/1994 | Röck et al. | 312/334.6 |

FOREIGN PATENT DOCUMENTS

| | | |
|---|---|---|
| 2701712 | 7/1978 | Germany . |
| 3627408 | 10/1987 | Germany . |
| 903221 | 8/1962 | United Kingdom . |

*Primary Examiner*—José V. Chen
*Assistant Examiner*—Robert J. Sandy
*Attorney, Agent, or Firm*—Wenderoth, Lind & Ponack

[57] ABSTRACT

A pull-out guide for drawers, having a carcass-side bearing rail (3) and a drawer-side pull-out rail (6) at each side of the drawer. Load-transmitting rollers (4, 16, 17) are mounted on the rails (3, 6). The rails (3, 6) have running webs for the rollers (4, 16, 17) and the rollers (4, 16, 17) of the bearing rails (3) and of the pull-out rails (6) are offset perpendicular with respect to the pull-out direction of the pull-out rails (6) such that the pull-out rails (6) are guided in two tracks. At least one bracket (13, 30) is mounted at the rear end of the pull-out rail (6) the bracket (13, 30, 31) having a horizontal web (33) abbuting the running web (22) of the pull-out rail (6) or a support block (12) of plastics being inserted between the horizontal web (23) of the bracket (13) and the running web (22) of the pull-out rail (6). There are mounted on the bracket (13, 31) two rollers (16, 17) which are arranged one above the other and which receive between them the running web (18) of the bearing rail (3). The supporting block (12) of plastics is arranged in the track of the roller (4) mounted on the bearing rail (3).

14 Claims, 8 Drawing Sheets

PULL-OUT GUIDE ASSEMBLY FOR DRAWERS

This application is a continuation in part of application Ser. No. 08/203,375 filed Mar. 1, 1994 now abandoned.

BACKGROUND OF THE INVENTION

The invention relates to a pull-out guide assembly to be used at each side of a drawer to guide movement of the drawer into and out of a furniture body, and assembly comprising:

a bearing rail to be mounted on a side wall of the furniture body, said bearing rail having a vertical bearing web, a running web extending laterally from said vertical bearing web, and a roller mounted on a side of said vertical bearing web opposite said running web;

a pull-out rail to be mounted on a side of the drawer, said pull-out rail having a running web, and two rollers, one mounted above the other.

A pull-out guide of this type is described in DE-A1 36 27 408. It is not suitable for receiving drawers having heavy contents.

SUMMARY OF THE INVENTION

The object of the invention is to improve a pull-out guide of this type such that a good tip-safe guidance of the pull-out rails on the bearing rails is ensured.

The object according to the invention is achieved in that said bearing and pull-out rails being assembled with said two rollers of said pull-out rail receiving therebetween and running on opposite sides of said running web of said bearing rail, with said roller of said bearing rail being offset relative to said two rollers of said pull-out rail in a direction transverse to the longitudinal direction of said rails, thereby defining two tracks of guiding movement of the drawer, and with said roller of said bearing rail located relative to said rollers of said pull-out rail at a position to be closer to the furniture body than are said rollers of said pull-out rail.

In order to achieve that the pull-out rails can be made of relative thin steel and still have appropriate bearing properties a bracket is fastened to a rear end of said pull-out rail to reinforce said running web thereof.

A preferred embodiment of the invention, in which the suspension of a drawer removed completely from the furniture carcass is facilitated, provides for a support block, preferably of plastics, to be arranged at the rear ends of the pull-out rail next to the upper roller in the track of the roller mounted on the bearing rail.

BRIEF DESCRIPTION OF THE DRAWINGS

FIG. 13 shows a diagram of the pull-out rail according to the invention, in the guide inserted into the drawer frame.

DESCRIPTION OF THE PREFERRED EMBODIMENTS

Figure 1:
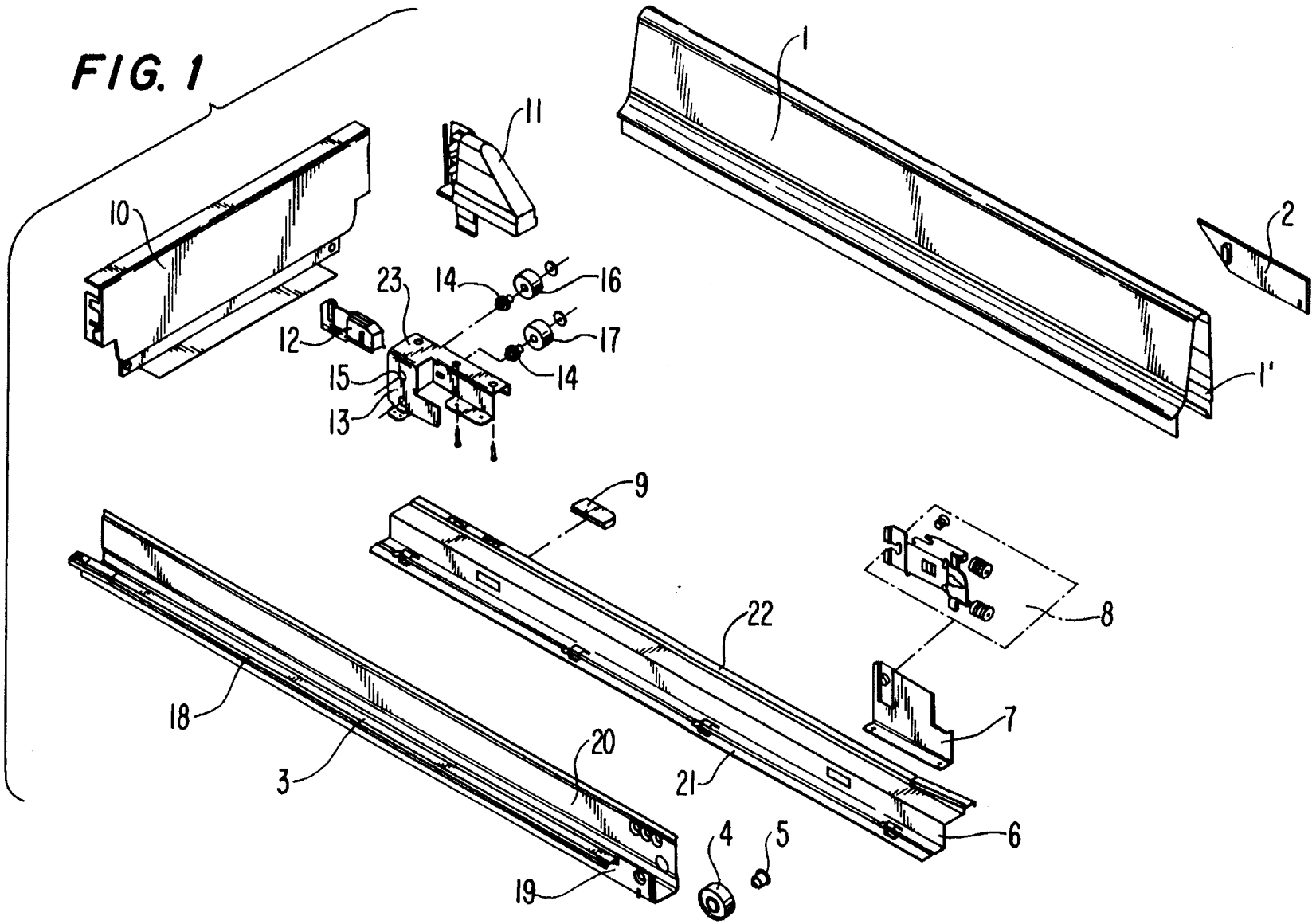
FIG. 1 shows, in schematic and exploded manner, a pull-out guide according to the invention having a drawer frame and the drawer rear wall.
Figure 2:
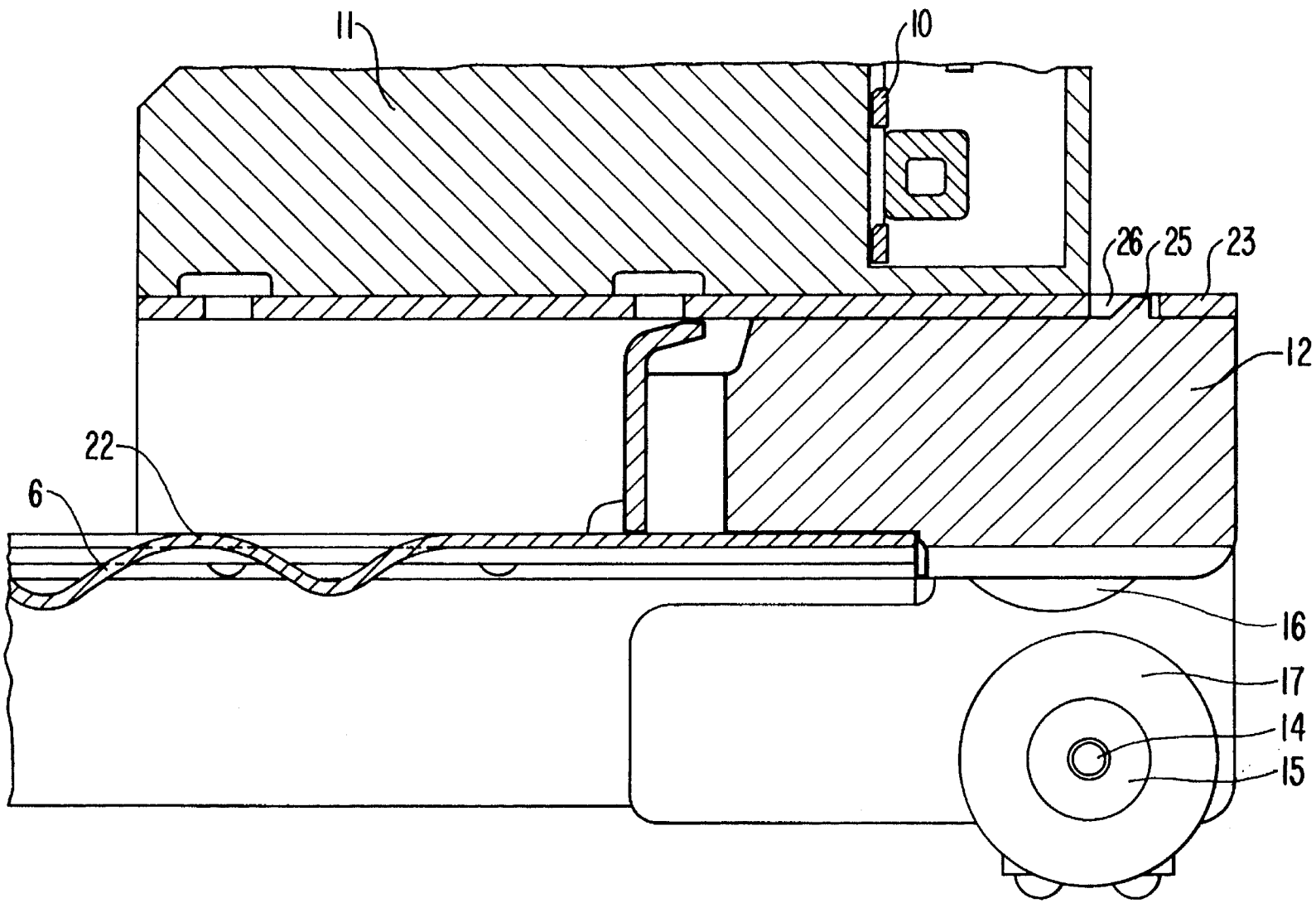
FIG. 2 shows a section through a pull-out rail according to the invention, in the rear region.
Figure 3:
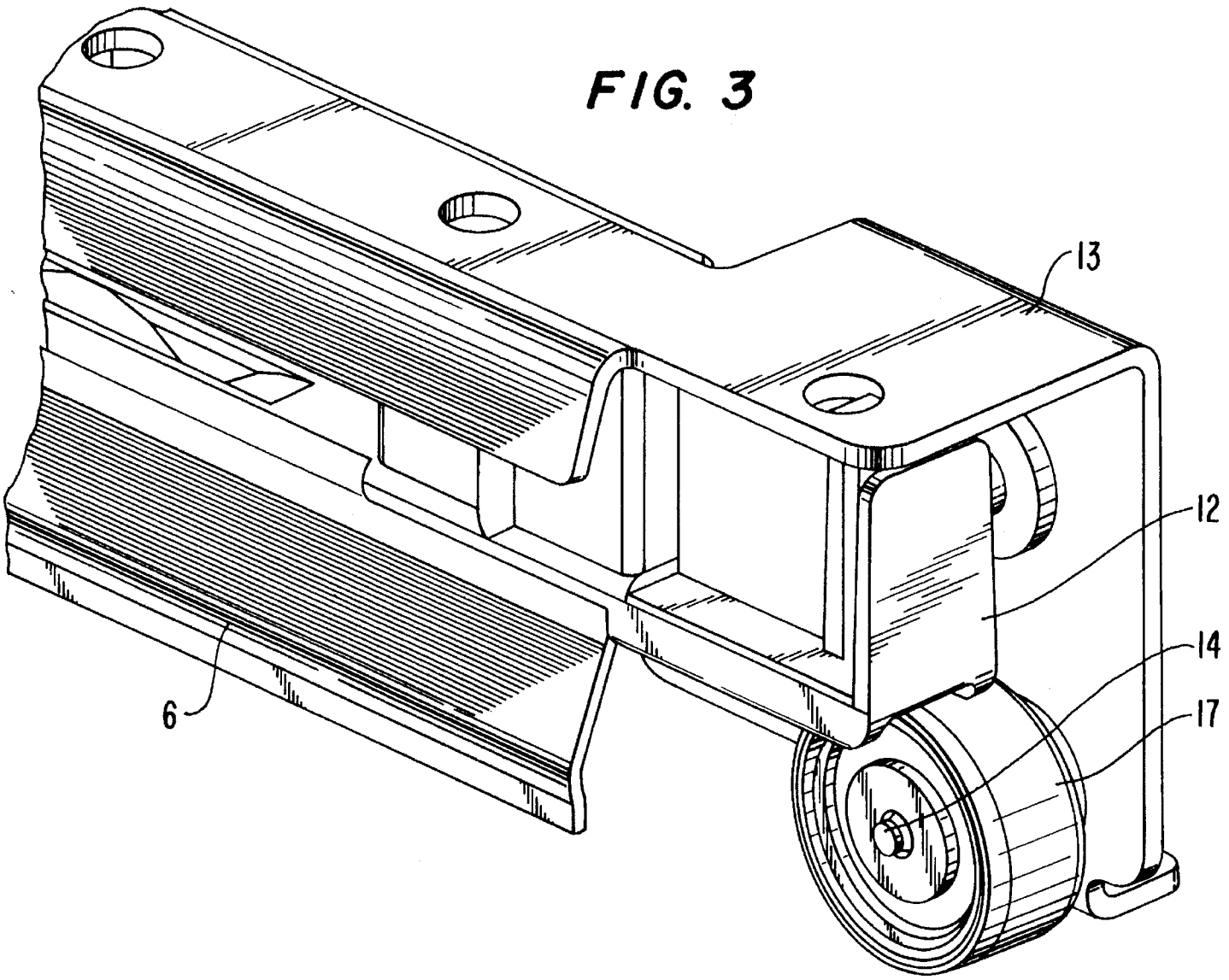
Figure 4:
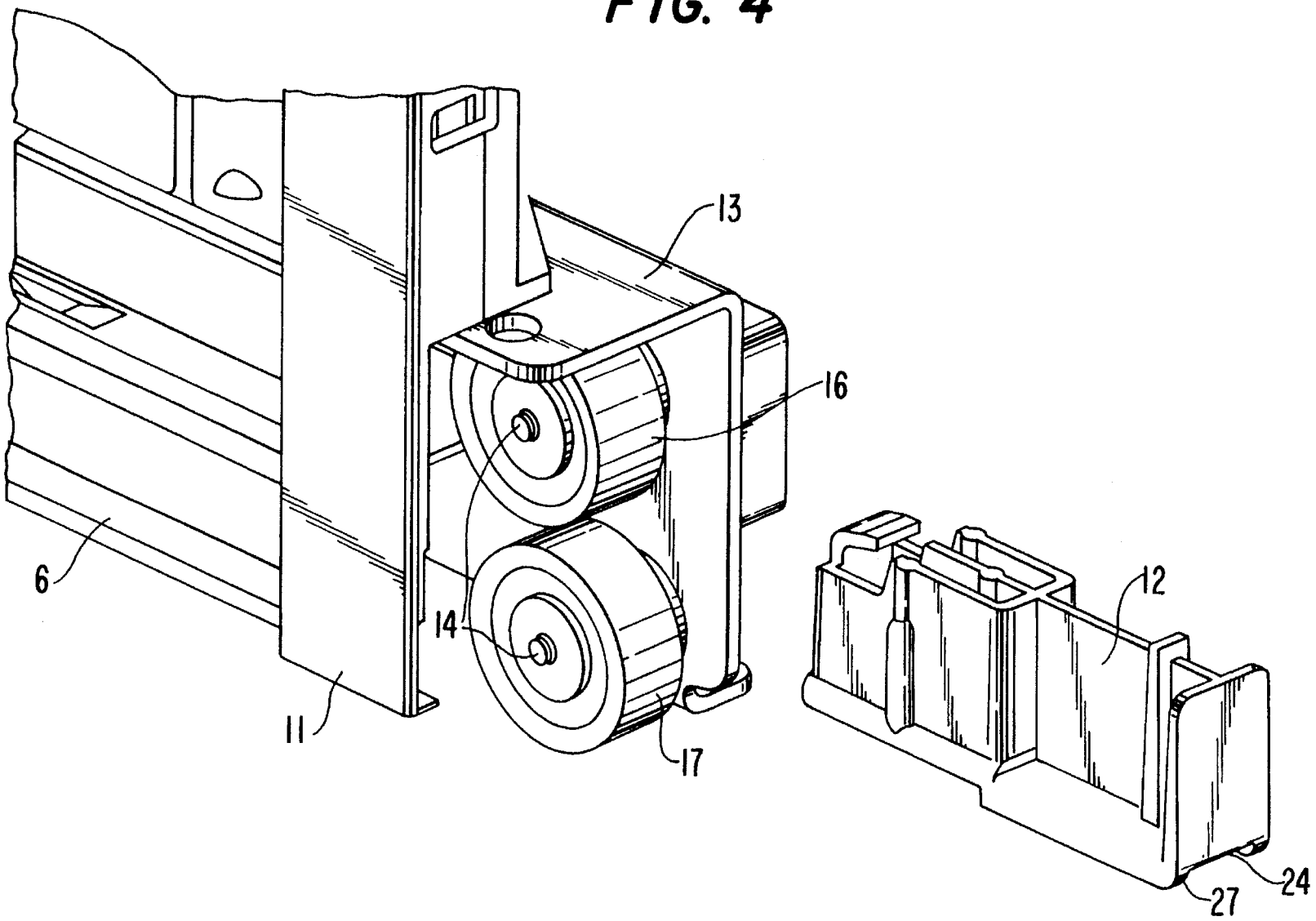

The pull-out guide according to the invention has on each side of the drawer a bearing rail 3 secured to the furniture carcass side walls and a pull-out rail 6 connected to the drawer frame 1. The bearing rail 3 has a running web 18 and is provided at the side of a vertical web 19 opposite the running web 18 with a roller 4 which is mounted on the vertical web 19 by means of a rivet 5.

The bearing rail 3 is screwed in conventional manner to the furniture side wall or frame parts of a furniture carcass by way of a securing web 20. The bearing rail 3 here describes an assembled Z- and U-shaped profile ( FIG. 5 ).

The pull-out rail 6 bears at the front end a holding plate on which a front fitting 8 for securing a front panel can be screwed. In the drawer frame 1, located in the outer wall 1' in the region of the front fitting 8, is a cutout which enables the access of a tool to the front fitting 8 and which is covered by a cover cap 2.

The pull-out rail 6 is further provided with a supporting web 21 for the drawer base and a running web 22 for the bearing rail-side roller 4.

At the rear end of the pull-out rail 6 a bracket 13 is secured, for example screwed or riveted, to the pull-out rail 6. The bracket 13 bears two rollers 16, 17 which are arranged one above the other and which are mounted on the bracket 13 and thus on the pull-out rail 6 by means of rivets 14 which projects through holes 15 in the bracket 13.

Figure 5:
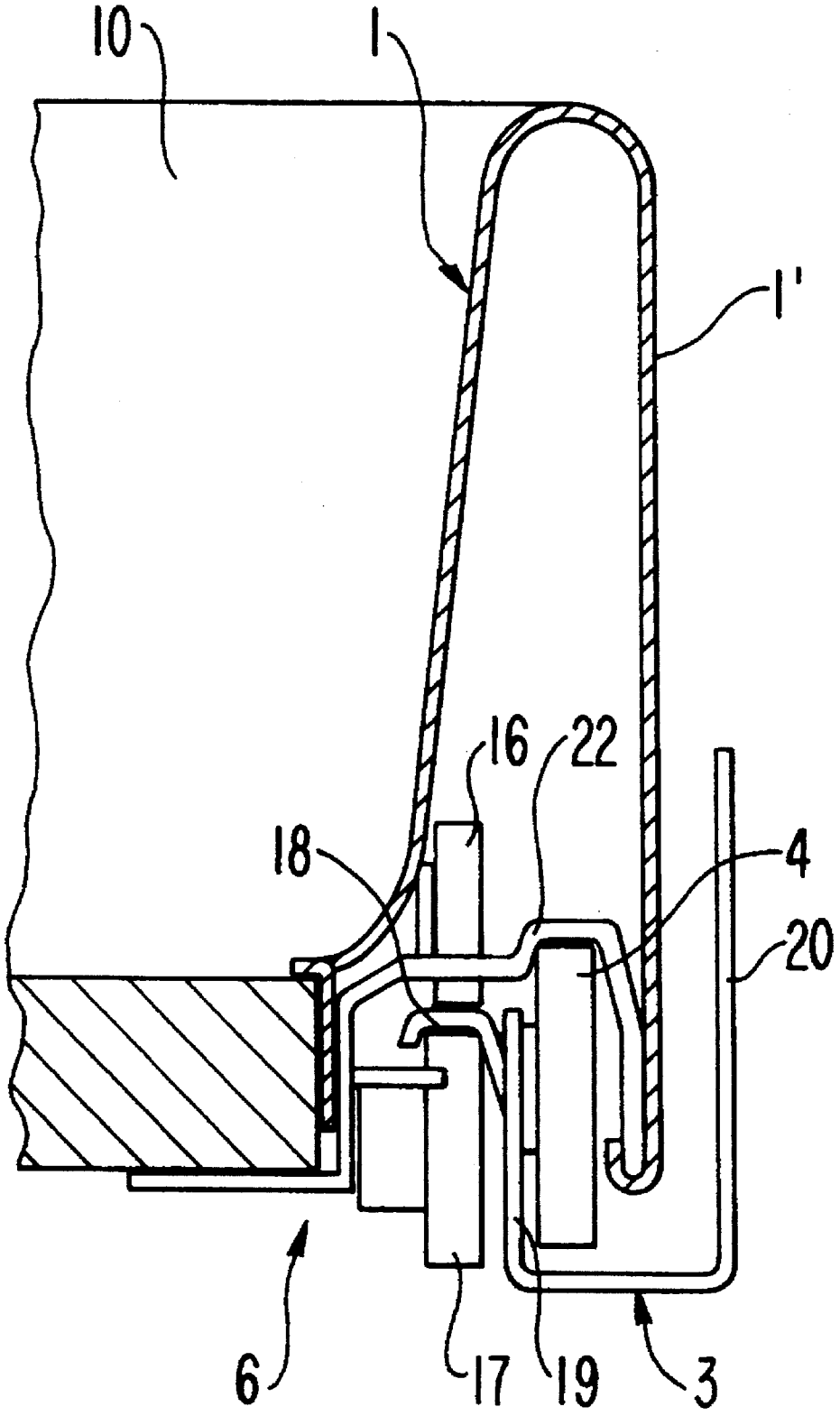

When the drawer is pushed into the furniture carcass, the rollers 16, 17, as can be seen in particular from FIG. 5, are located above and below the running web 18 of the bearing rail 3. The pull-out rails 6 and the drawer are thus guided in tip-safe manner on the bearing rails 3.

The bracket 13 has an upper horizontal web 23. Inserted between the upper horizontal web 23 of the bracket 13 and the running web 22 of the pull-out rail 6 is a support block 12 which projects rearwards beyond the running web 22 of the pull-out rail 6 and has a run-on surface 24 which extends the running web 22 beyond the rollers 16, 17.

The support block 12 has a lug 25 which projects into a hole 26, for example a punched hole in the horizontal web 23 of the bracket 13, and holds the support block 12 which is inserted between the bracket 13 and the horizontal web 22 of the pull-out rail 6.

The assembly of the rollers 16, 17 on producing the pull-out guide is facilitated by the fact that the running web 22 of the pull-out rail 6 terminates before the rollers 16, 17. The support block 12 can easily be inserted between the bracket 13 and the pull-out rail 6 after the rollers 16, 17 have been assembled. It facilitates the suspension of the drawer removed from the furniture carcass and improves the take-up of force by the pull-out rail 6.

In order to improve the guidance of the bearing rail-side roller 4 in the region of the run-on block 12, the latter is provided with lateral guide cheeks 27. The guide cheeks 27 exactly match the oblique side webs of the downwardly open profile of the running web 18. The running web 22 of the pull-out rail 6 also has a downwardly open profile in which the roller 4 is guided. Also mounted on the bracket 13 is a rear wall holding means 11 for the rear wall 10.

Mounted in the vertical web of the pull-out rail 6 is a block 9, preferably of plastics, which improves the lateral guidance of the pull-out rail 6.

Figure 6:
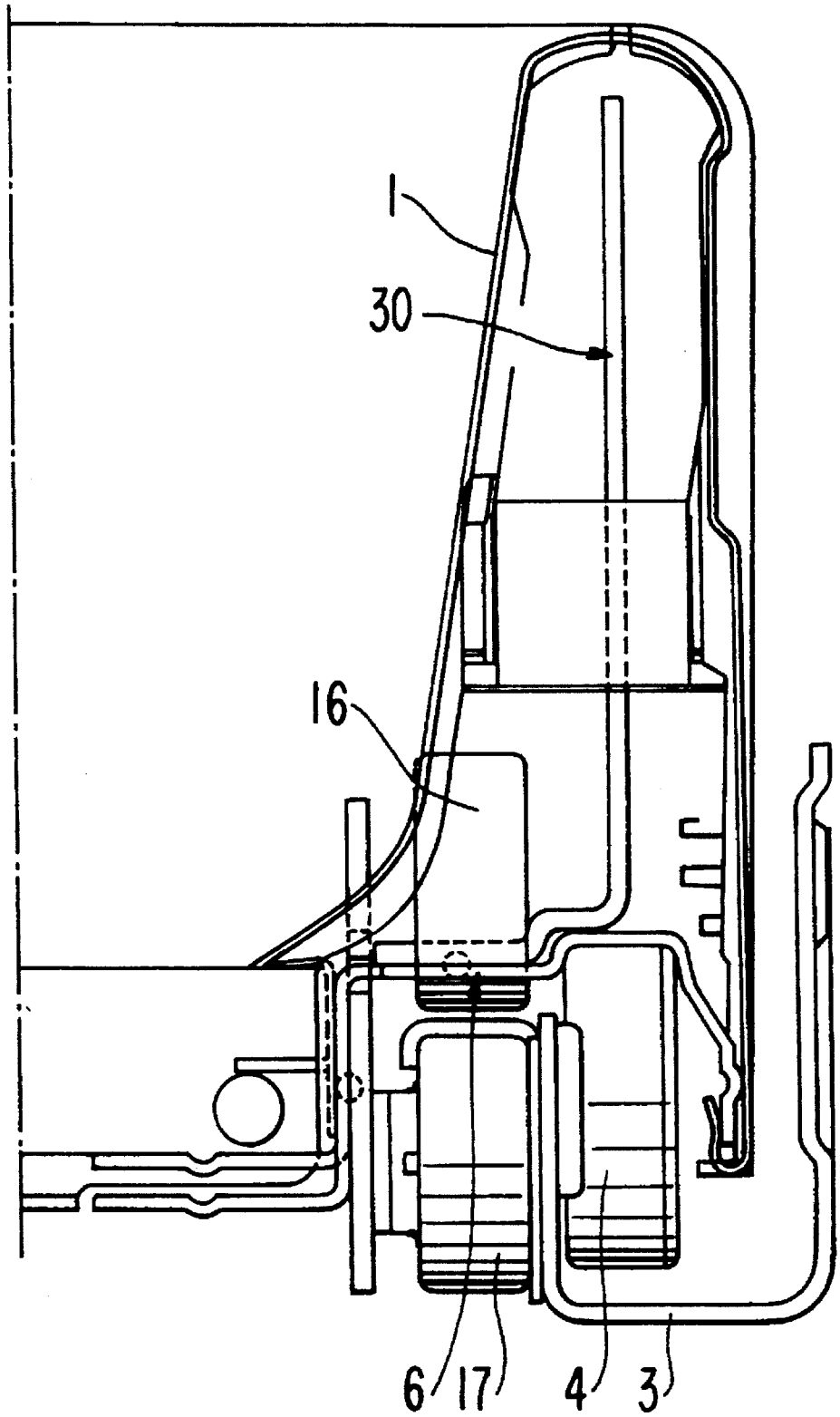
FIG. 6 shows an end view of the pull-out guide inserted into the drawer frame according to a second embodiment of the invention.
Figure 7:
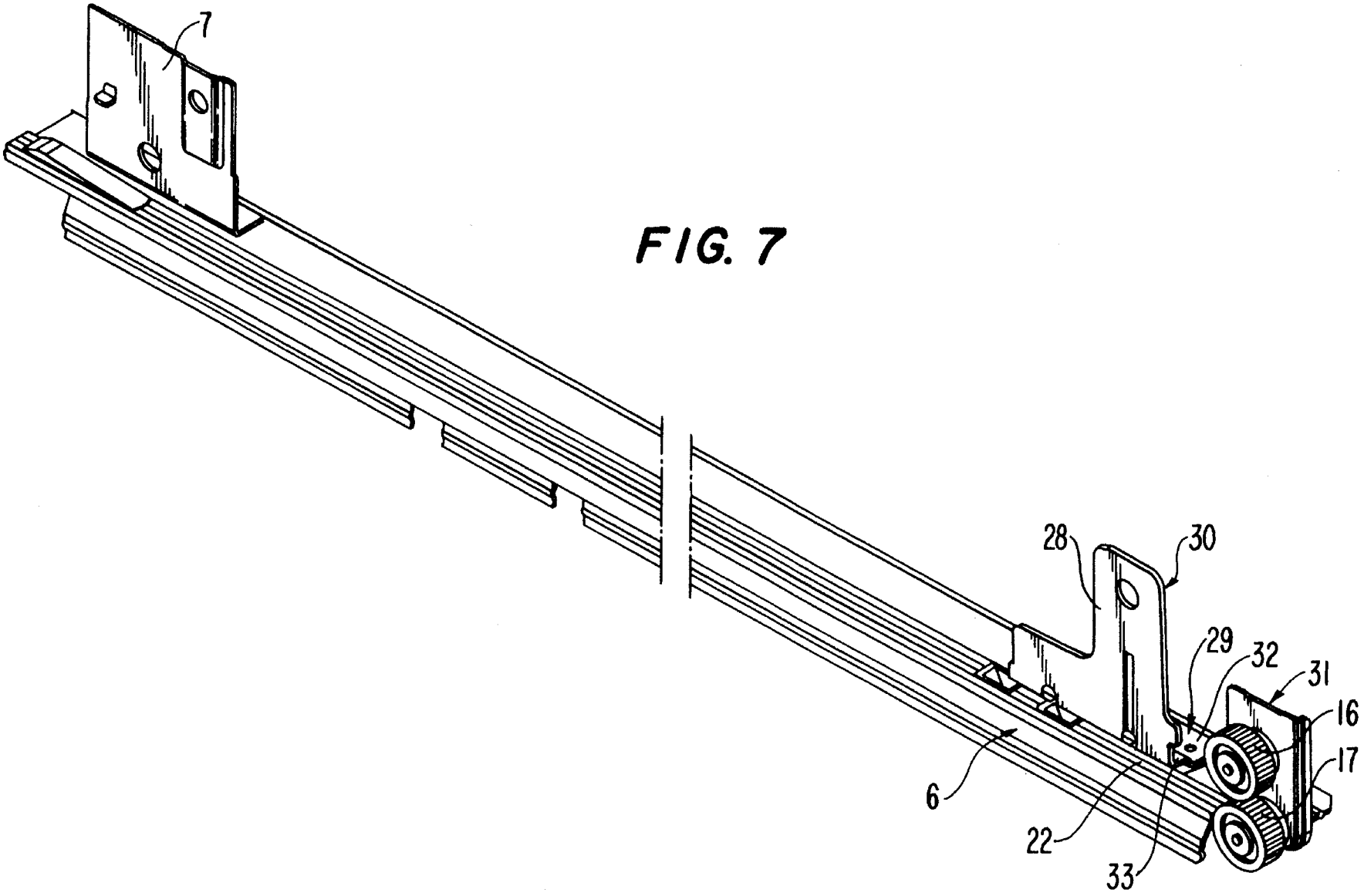
FIG. 7 shows a diagrammatic view of the rear end of a pull-out rail according to this invention.
Figure 8:
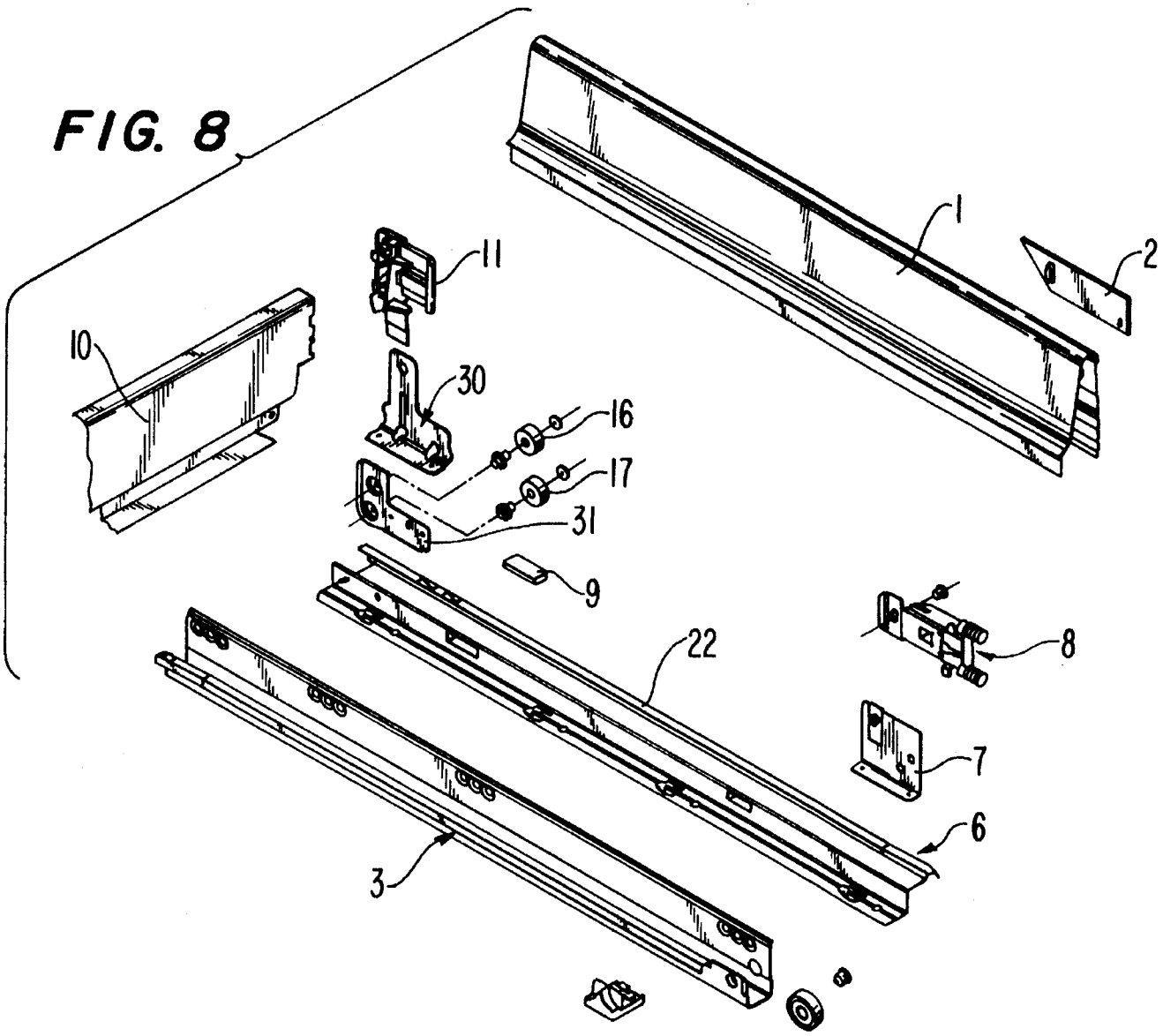
FIG. 8 shows in schematic and exploded manner the pull-out guide assembly according to this embodiment.

According to the embodiment of FIGS. 6 to 7 two brackets 30, 31 are fastened to the rear end of the pull-out rail 6 instead of one bracket 13. On the rear bracket 31 the rollers 16, 17 of the pull-out rail 6 are mounted. These rollers 16, 17 cooperate with the running web 18 of the bearing rail 3 just like in the first embodiment of the invention.

The bracket 30 which is also fastened to the pull-out rail 6 is, as seen from the rear, L-shaped with a vertical leg 28 and a horizontal leg 29.

The horizontal leg 29 is bent stepwise showing a lower fastening web 32 and a horizontal web 33 which abuts the running web 22 of the pull-out rail 6.

The fastening web 32 is riveted to a horizontal web of the pull-out rail 6.

The holding means 11 for the rear wall 10 are fastened to the vertical leg 28 of the bracket 30.

Also in the case of this embodiment the horizontal web 33 provides a reinforcement for the running web 22 of the pull-out rail 6 just like the horizontal web 23 of the bracket 13 does. The only difference is that the horizontal web 33 bears directly onto the running web 22 without any plastic plug being inserted between the two members.

We claim:

1. A pull-out guide assembly to be used at each side of a drawer to guide movement of the drawer into and out of a furniture body, said assembly comprising:

a bearing rail to be mounted on a side wall of the furniture body, said bearing rail having a vertical bearing web, a running web extending laterally from said vertical bearing web, and a roller mounted on a side of said vertical bearing web opposite said running web;

a pull-out rail to be mounted on a side of the drawer, said pull-out rail having a running web, and two rollers, one mounted above the other; and said bearing and pull-out rails being assembled with said two rollers of said pull-out rail receiving therebetween and running on opposite sides of said running web of said bearing rail, with said roller of said bearing rail being offset relative to said two rollers of said pull-out rail in a direction transverse to the longitudinal direction of said rails, thereby defining two tracks of guiding movement of the drawer, and with said roller of said bearing rail located relative to said rollers of said pull-out rail at a position to be closer to the furniture body than are said rollers of said pull-out rail.

2. An assembly as claimed in claim 1, wherein said bearing rail has approximately a U-shaped transverse cross-sectional configuration including first and second vertical webs joined by a horizontal web, said first vertical web comprising said vertical bearing web, said second vertical web to be fastened to the furniture body, and said running web of said bearing rail extending from said first vertical web in a direction away from said second vertical web.

3. An assembly as claimed in claim 1, further comprising a bracket fastened to a rear end of said pull-out rail to reinforce said running web thereof.

4. An assembly as claimed in claim 3, wherein said bracket includes a horizontal web abutting said running web of said pull-out rail.

5. An assembly as claimed in claim 3, wherein said bracket is fastened to a horizontal web of said pull-out rail that is adjacent to said running web thereof.

6. An assembly as claimed in claim 3, wherein said bracket includes a vertical leg having attached thereto a holding member to be connected to a rear wall of the drawer.

7. An assembly as claimed in claim 3, wherein said bracket includes a first bracket member having mounted thereon said two rollers of said pull-out rail and a second bracket member having a horizontal web abutting said running web of said pull-out rail.

8. An assembly as claimed in claim 1, further comprising a support block mounted at a rear end of said pull out rail adjacent to the upper of said two rollers thereof at a position of the track of said roller of said bearing rail along said running web of said pull-out rail.

9. An assembly as claimed in claim 8, wherein said support block is formed of plastic.

10. An assembly as claimed in claim 8, wherein said support block includes a surface at the level of and providing an extension of a surface of said running web of said pull-out rail on which runs said roller of said bearing rail.

11. An assembly as claimed in claim 8, wherein said support block includes projections on opposite sides of said surface to guide said roller of said bearing rail.

12. An assembly as claimed in claim 8, wherein said two rollers are located on said pull-out rail rearwardly of said running web thereof.

13. An assembly as claimed in claim 8, wherein said two rollers of said pull-out rail are mounted on a bracket secured to a rear end thereof, said bracket having an inverted U-shaped transverse cross-sectional configuration including two vertical webs joined by a horizontal web, and said supporting block is inserted between said bracket and said running web of said pull-out rail and is supported against said horizontal web of said bracket.

14. An assembly as claimed in claim 13, wherein said support block has a lug projecting into a hole in said horizontal web of said bracket.

* * * * *